US006766908B2

(12) United States Patent
Chandaria

(10) Patent No.: US 6,766,908 B2
(45) Date of Patent: Jul. 27, 2004

(54) BULK PACKING OF FIRELOGS

(75) Inventor: Sachen Chandaria, Nairobi (KE)

(73) Assignee: Conros Corporation, Ontario (CA)

( * ) Notice: Subject to any disclaimer, the term of this patent is extended or adjusted under 35 U.S.C. 154(b) by 191 days.

(21) Appl. No.: 09/949,179

(22) Filed: Sep. 7, 2001

(65) Prior Publication Data

US 2003/0047478 A1 Mar. 13, 2003

(51) Int. Cl.[7] ..... B65D 85/20
(52) U.S. Cl. ..... 206/738; 206/772; 206/782
(58) Field of Search ..... 206/499, 738, 206/745, 746, 769, 772, 45.29, 775, 781, 782

(56) References Cited

U.S. PATENT DOCUMENTS

| | | | | | |
|---|---|---|---|---|---|
| 1,879,105 | A | * | 9/1932 | Corigliano | 206/752 |
| 2,131,391 | A | * | 9/1938 | Schraffenberger | 206/746 |
| 4,155,459 | A | | 5/1979 | Marschak | |
| 4,201,291 | A | * | 5/1980 | Davidson | 206/768 |
| 4,382,504 | A | * | 5/1983 | Vesborg | 206/766 |
| 4,467,947 | A | | 8/1984 | Minneman | |
| 5,048,690 | A | * | 9/1991 | Zimmerman | 206/746 |
| 5,050,738 | A | * | 9/1991 | McAdams | 206/497 |
| 5,551,563 | A | | 9/1996 | Allen | |
| 5,555,965 | A | | 9/1996 | Mishina | |
| 5,595,304 | A | * | 1/1997 | Timmins | 206/598 |
| 5,766,275 | A | | 6/1998 | Chandaria | |
| D397,780 | S | | 9/1998 | Chandaria | |
| 5,858,036 | A | | 1/1999 | Chandaria | |
| 6,132,481 | A | | 10/2000 | Chandaria | |
| 6,196,215 | B1 | | 3/2001 | Chandaria | |
| 6,245,119 | B1 | | 6/2001 | Chandaria | |

* cited by examiner

*Primary Examiner*—Jacob K. Ackun, Jr.
(74) *Attorney, Agent, or Firm*—Sand & Sebolt

(57) ABSTRACT

A container for the bulk packing and display of artificial firelogs comprising a generally rectangular base panel having a front side rear side and opposed ends, a generally rectangular rear panel extending generally perpendicularly upwardly from the rear side of said base panel to a rear top edge, opposed generally rectangular end panels extending generally perpendicularly upwardly from the opposed ends of base panel to a pair of generally parallel top edges, and a front panel extending generally perpendicularly from the front side of the rectangular base panel to a top front edge, wherein said front panel has at least one cut away section.

22 Claims, 11 Drawing Sheets

BULK PACKING OF FIRELOGS

CROSS REFERENCE TO RELATED APPLICATION

This application is related to U.S. patent application Ser. No. 29/147,889, entitled CONTAINER FOR BULK PACKING OF FIRELOGS, filed by the applicant on even date with this application, namely on Sep. 7, 2001.

BACKGROUND OF THE INVENTION

1. Technical Field

As an application generally relates to composite synthetic fuels, and more particularly to firelogs. Still more particularly, this application relates to containers for and methods of packaging, displaying and dispensing firelogs for retail sale.

2. Background Information

Various types of fuel bodies have been developed, most of which are formed of particulate flammable materials which are compressed into a predetermined shape. The particulate materials are combined with various wax binders and other binders to form maintain the desired shape of the final fuel body. These bodies also may contain various types of additives therein to enhance burning or to produce a colored flame.

Certain of these fuel bodies are of an elongated shape and are formed of compressed sawdust, coal particles, or other inflammable materials. These fuel bodies are typically referred to as firelogs and may be formed by a continuous extrusion process wherein the particulate inflammable materials and the appropriate binders and other materials are compressed within an extrusion bore, are cut to predetermined lengths, and are subsequently placed into a protective outer wrapper. The artificial firelog is then used by the consumer by placing it onto a fireplace grate and igniting the protective outer wrapper with a match or other flame source. The combustion of the protective outer wrapper burns in close proximity with the artificial firelog and ignites the firelog.

SUMMARY OF THE INVENTION

It is an object of the present invention to provide a means for packaging, displaying and dispensing firelogs which enables the retail buyer to buy one or a small number of firelogs.

It is a further object of the present invention to provide a means for packaging, displaying and dispensing firelogs which presents economies in terms of both retail store space and store employee time which would be required for its use.

It is still a further object of the present invention to provide a means of packaging, displaying and dispensing firelogs which securely holds a relatively large number of firelogs as compared with the cost of the structure.

These and other objects and advantages will be apparent from the present invention which is a container for the bulk packing and display of artificial firelogs comprising a generally rectangular base panel having a front side rear side and opposed ends, a generally rectangular rear panel extending generally perpendicularly upwardly from the rear side of said base panel to a rear top edge, opposed generally rectangular end panels extending generally perpendicularly upwardly from the opposed ends of base panel to a pair of generally parallel top edges, and a front panel extending generally perpendicularly from the front side of the rectangular base panel to a top front edge, wherein the front panel has at least one cut away section.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

DESCRIPTION OF THE PREFERRED EMBODIMENTS

Figure 1:
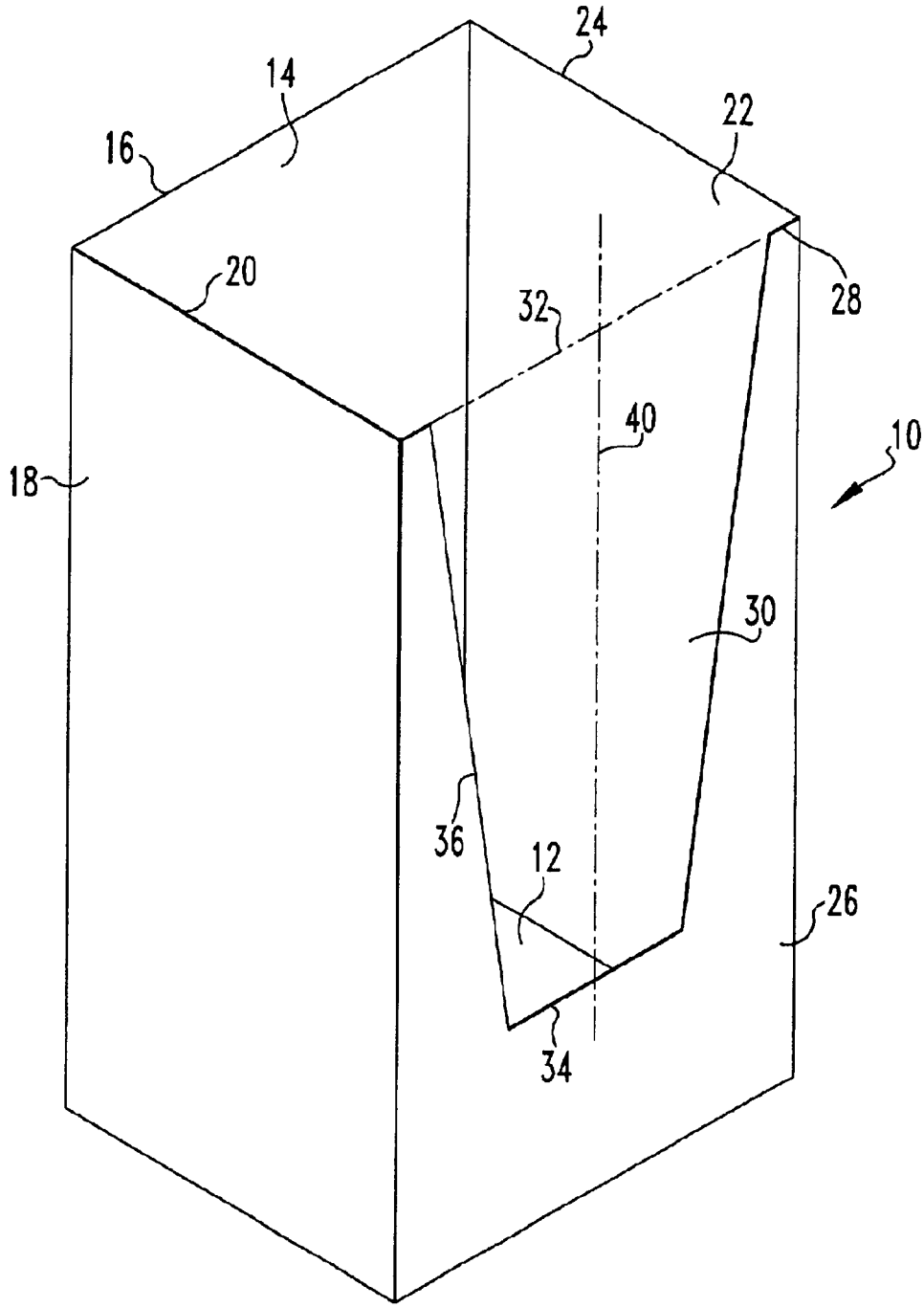
FIG. 1 is a front and side perspective view of a firelog container representing a preferred embodiment of the present invention.
Figure 3:
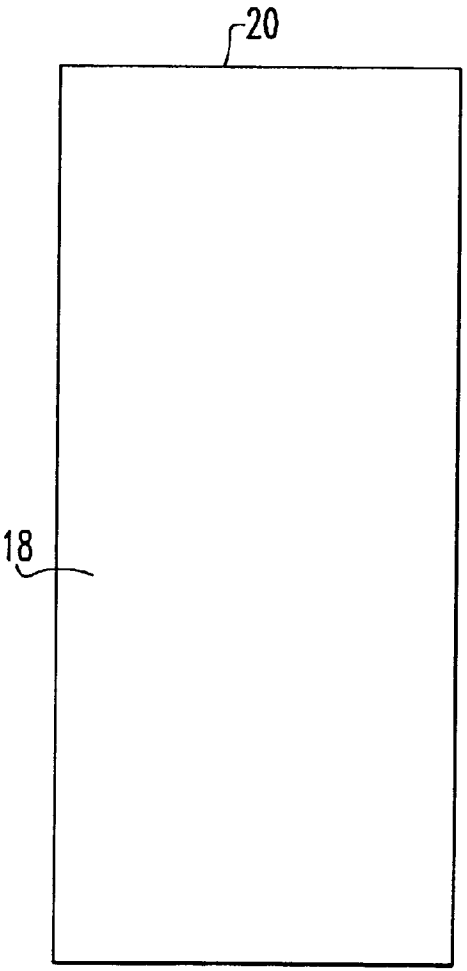
FIG. 3 is a side elevational view of the container shown in FIG. 1.
Figure 2:
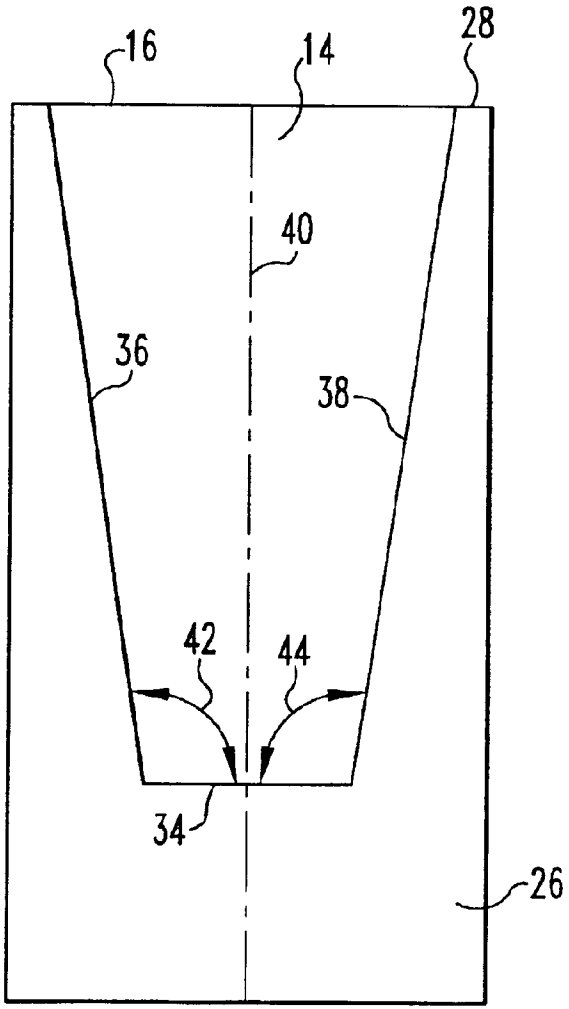
FIG. 2 is a front elevational view of the container shown in FIG. 1.
Figure 5:
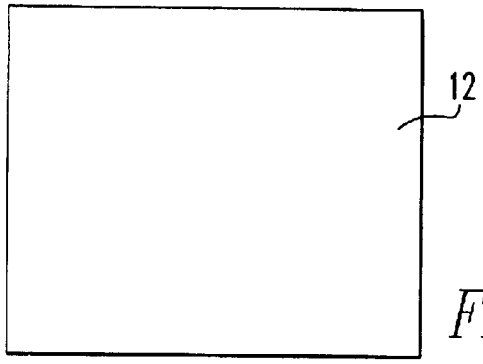
FIG. 5 is a top plan view of the container shown in FIG. 1.
Figure 4:
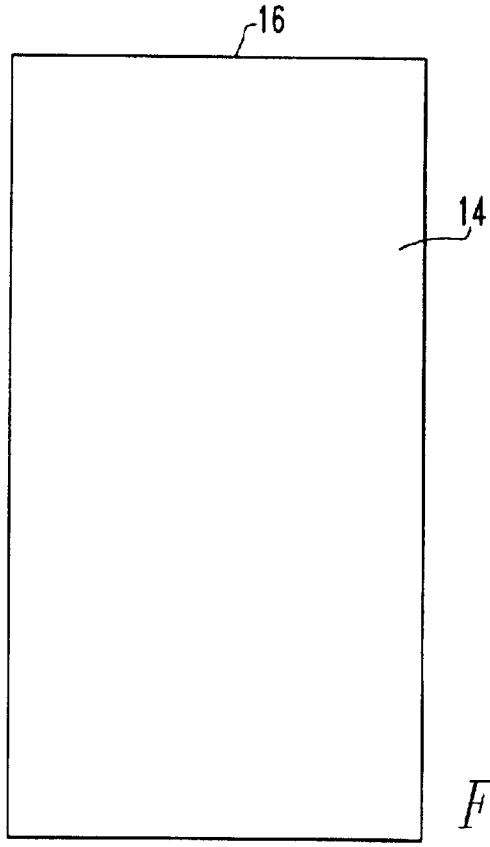
FIG. 4 is a rear elevational view of the container shown in FIG. 1.
Figure 6:
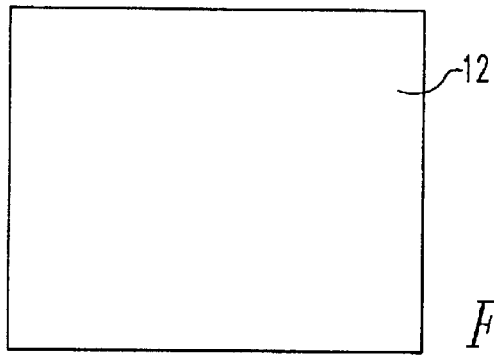
FIG. 6 is a bottom plan view of the container shown in FIG. 1.

Referring to FIGS. 1–6, container 10 includes a base panel 12 and a rear panel 14 which has a rear top edge 16. There is also a first end panel 18 with a top edge 20 and a second end panel 22 with a top edge 24. There is a front panel 26 with a top edge 28. On the front panel 26 there is a cutaway section 30 which has a top gap 32, a bottom side 34, and opposed lateral sides 26 and 38. The top gap 32 is larger than the bottom side 34 in this cutout section 30. There is also a centerline 40 which is perpendicular to the top gap 32 and the bottom side 34. The lateral sides 36 and 38 are sloped in opposed directions relative to the centerline 40. The angle 42 of between bottom side 34 and lateral side 36 is equal to angle 44 between bottom side 34 and lateral side 38. Preferably the angles 42 and 44 will be between 100° to 150°. It will be appreciated that the above described configuration of the cutout area allows for maximum access to firelogs stored in the interior 46 of the section while at the same time providing ample structural strength for the structure to allow for secure containment of a relatively heavy material such as firelogs.

Figure 7:
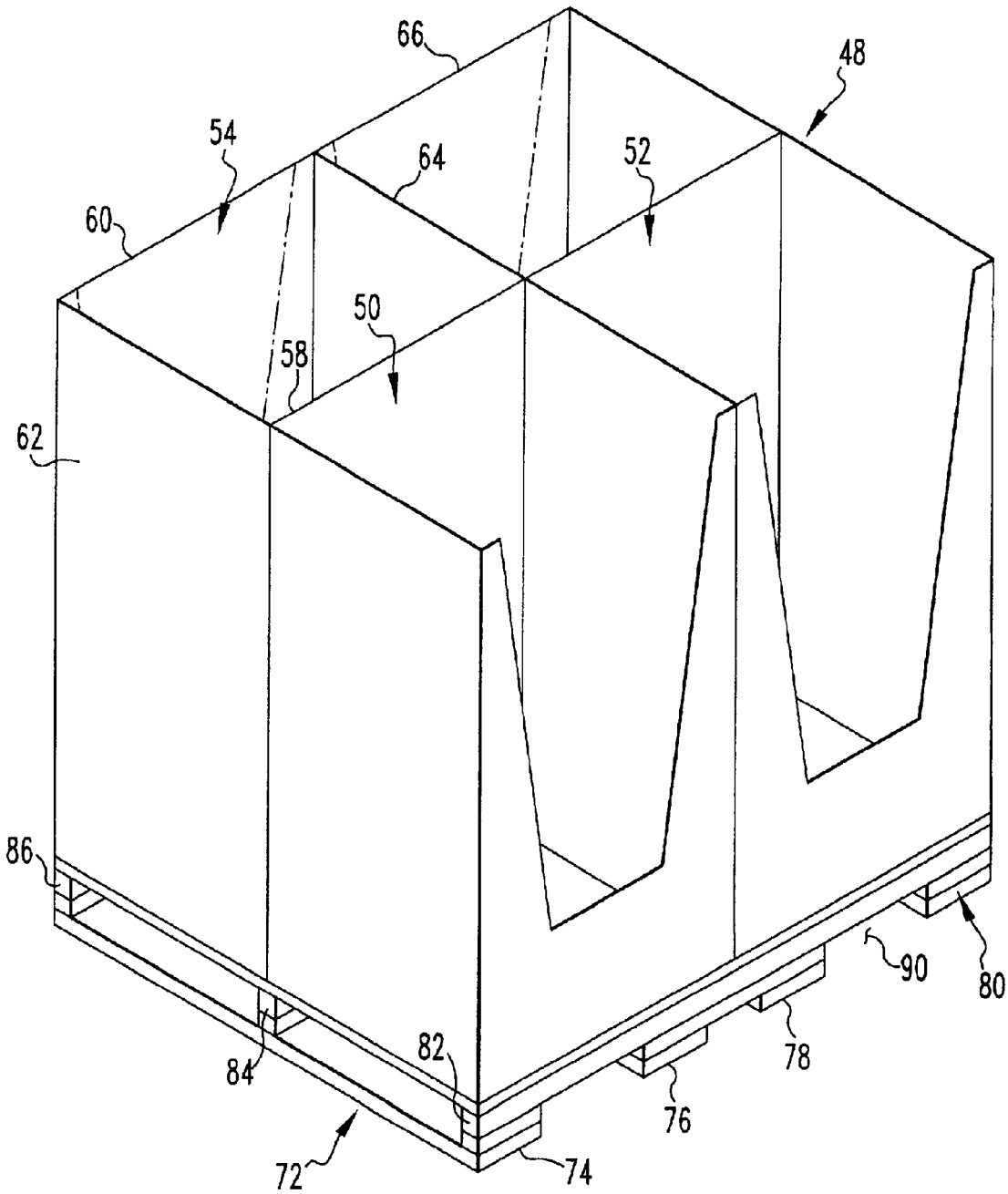
FIG. 7 is a front and side perspective view of a container representing another preferred embodiment of the present invention.
Figure 9:
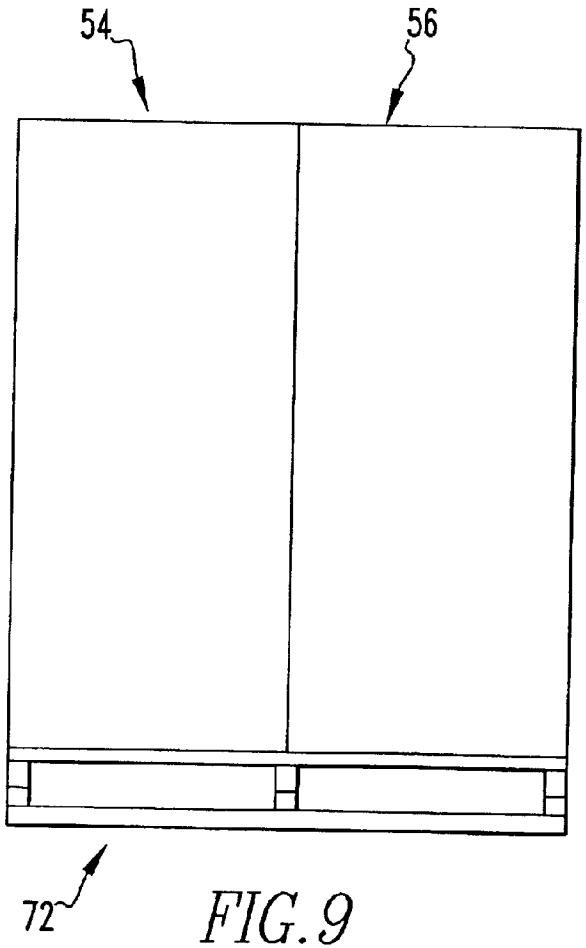
FIG. 9 is a side elevational view of the container shown in FIG. 7.
Figure 8:
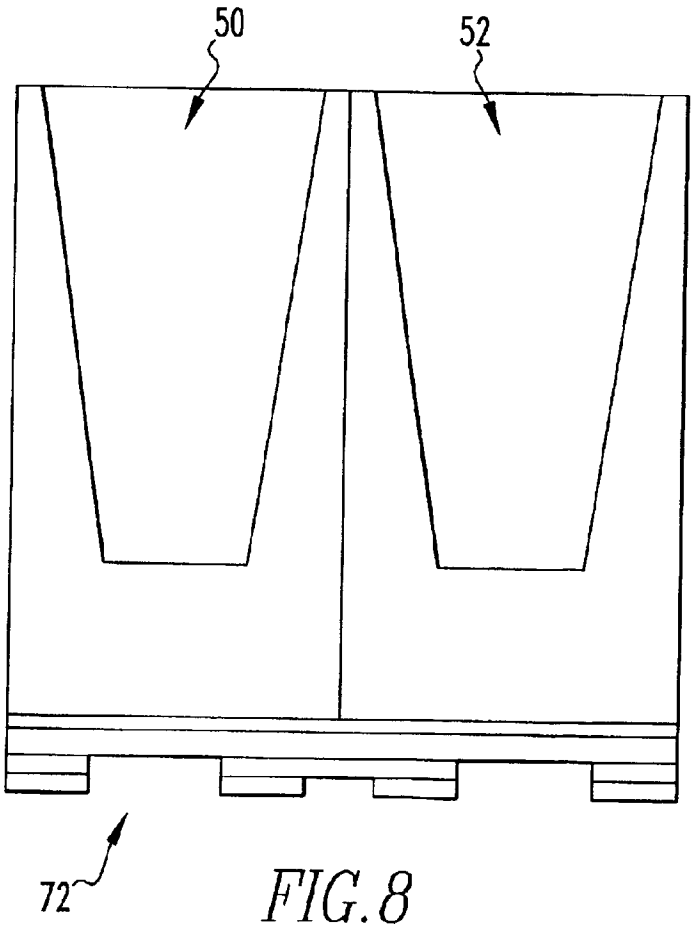
FIG. 8 is a front elevational view of the container shown in FIG. 7.
Figure 11:
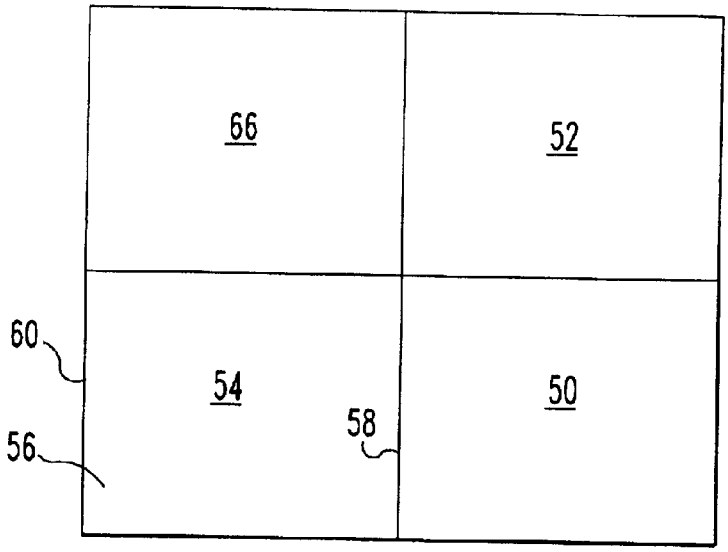
FIG. 11 is a top plan view of the container shown in FIG. 7.
Figure 10:
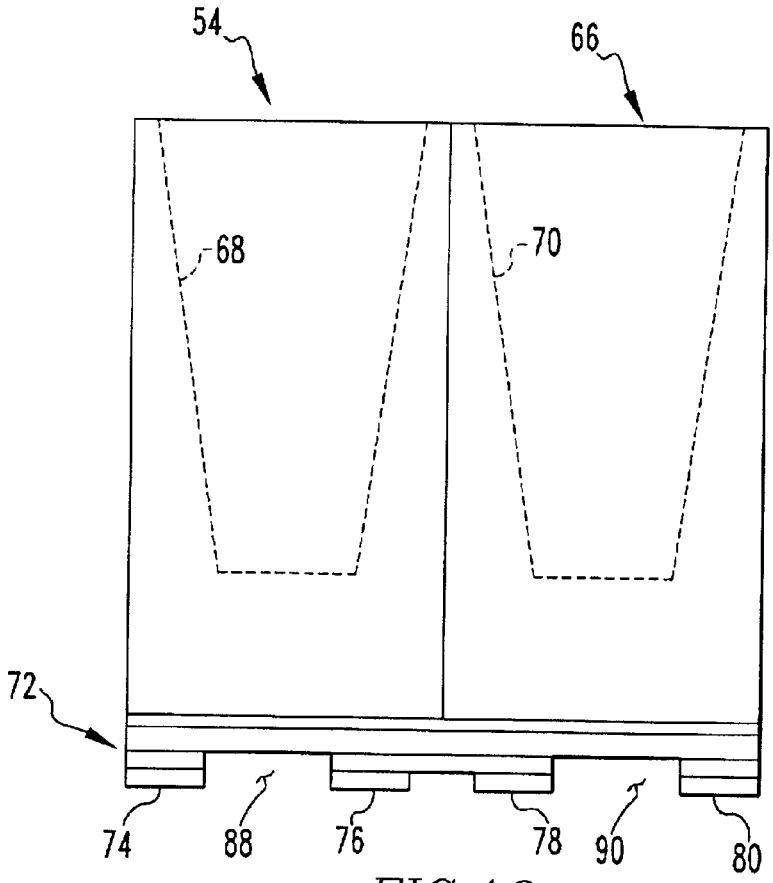
FIG. 10 is a rear elevational view of the container shown in FIG. 7.
Figure 12:
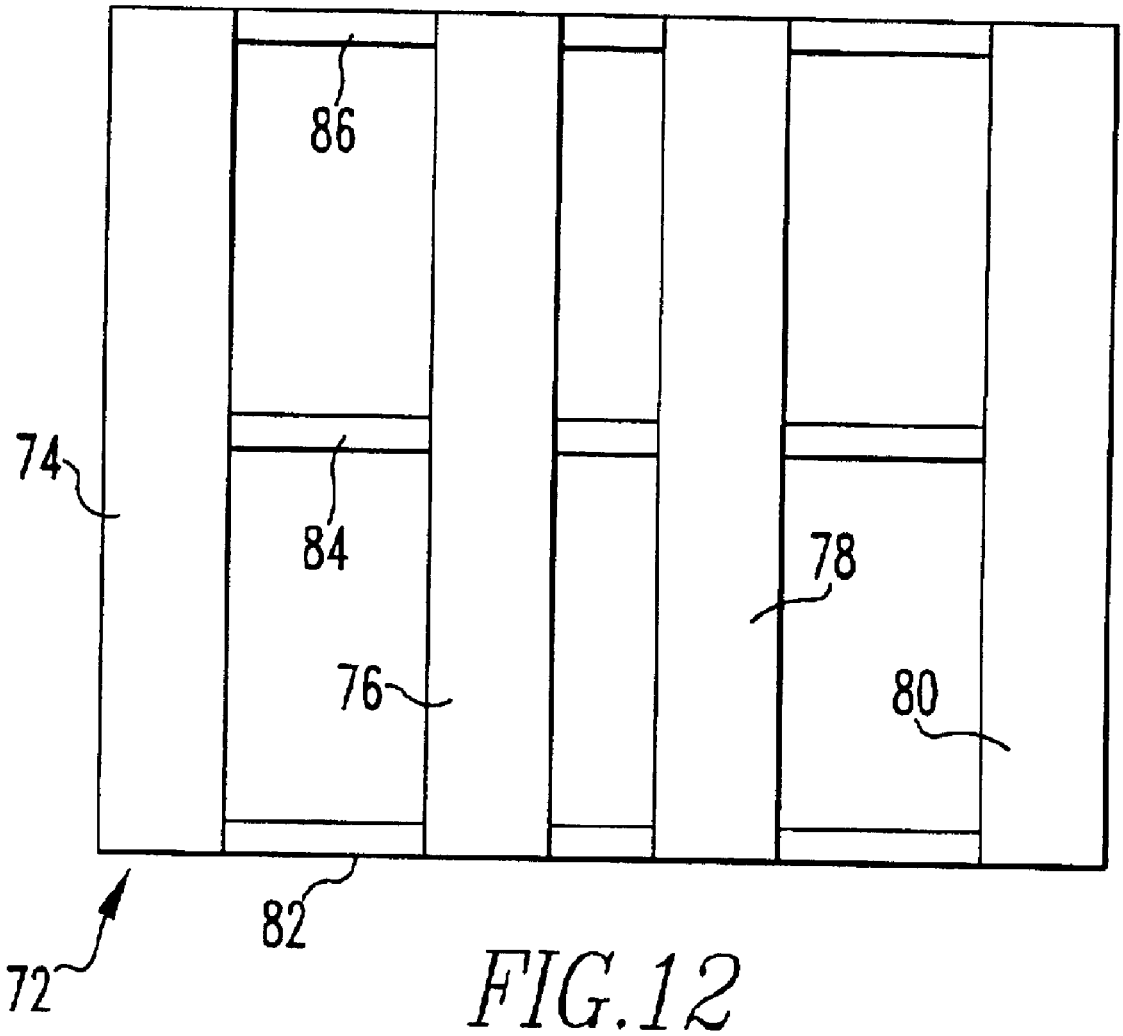
FIG. 12 is a bottom plan view of the container shown in FIG. 7.

Referring to FIGS. 7–12, a second preferred embodiment of the container of the present invention is shown. This container 48 includes one element 50 which is essentially identical to element 10 described above. Adjacent element 50 there is another element 52 which is also essentially identical to element 10 described above. At a position rearwardly of element 50 there is element 54 which is comprised of a base panel 56, a front panel 58, a rear panel 60, and opposed side panels 62 and 64. Adjacent element 54 and rearwardly of element 52 there is element 66 which is essentially identical to element 54. It will be understood that it would also be possible to place a cutaway section in elements 54 and 66 similar to cutaway section 30 in FIG. 1 in element 10 so as to allow access by buyers from both sides of the container 48. Such additional optional cutaway sections are shown in phantom lines in elements 54 and 66 respectively at 68 and 70.

Referring again to FIGS. 7–12, elements 50, 52, 54, and 66 are superimposed on a base palate shown generally at numeral 72. This base palate 68 includes longitudinal members 74, 76, 78, and 80. The base palate 68 also includes transverse members 82, 84, and 86. Between longitudinal elements 74 and 76 there is a fork receiving slot 88 and between longitudinal elements 78 and 80 there is a fork receiving slot 90 to allow container 48 to be manipulated by a forklift.

Figure 13:
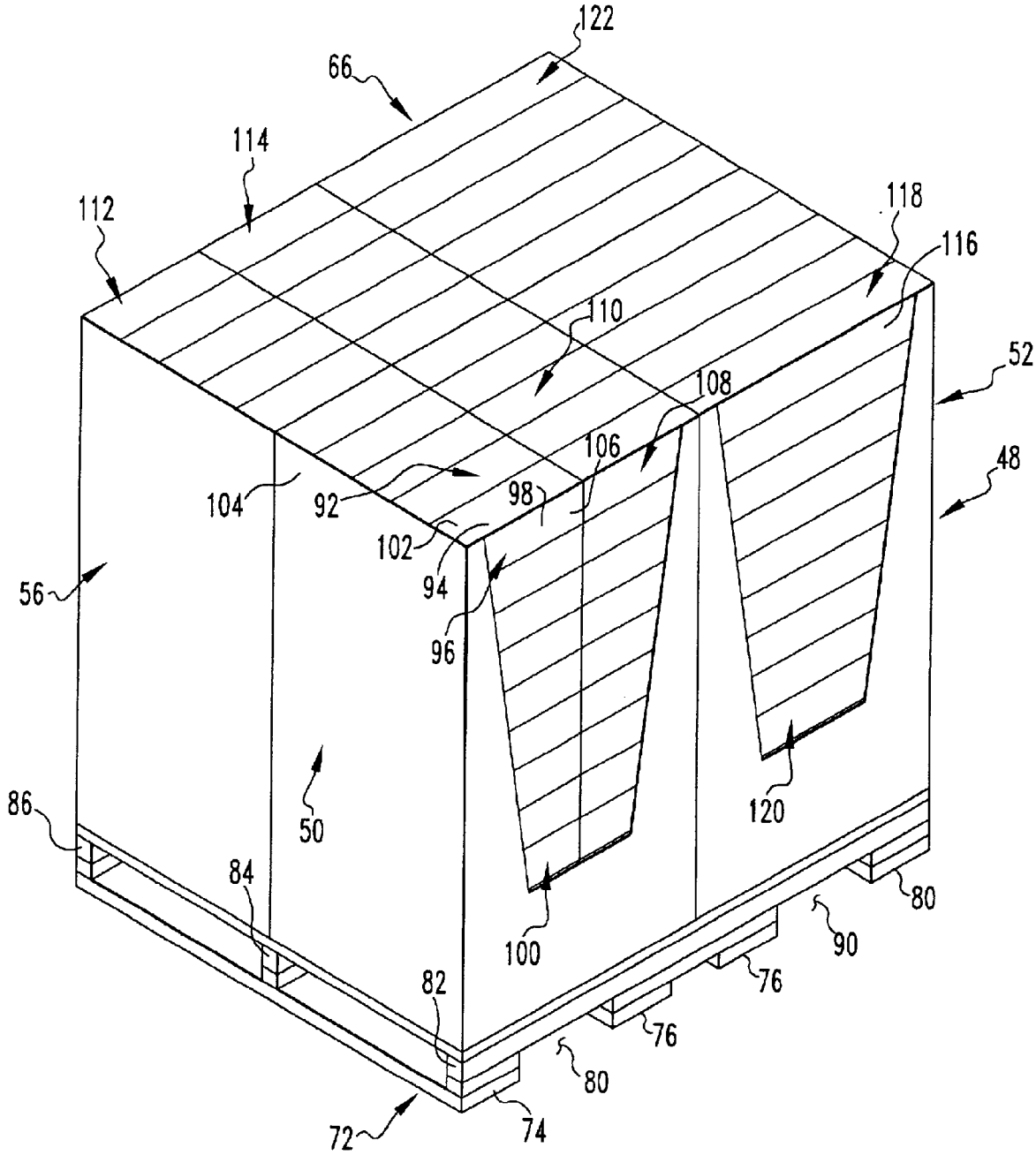
FIG. 13 is a front and side perspective view of the container shown in FIG. 7 in which firelogs are housed.
Figure 15:
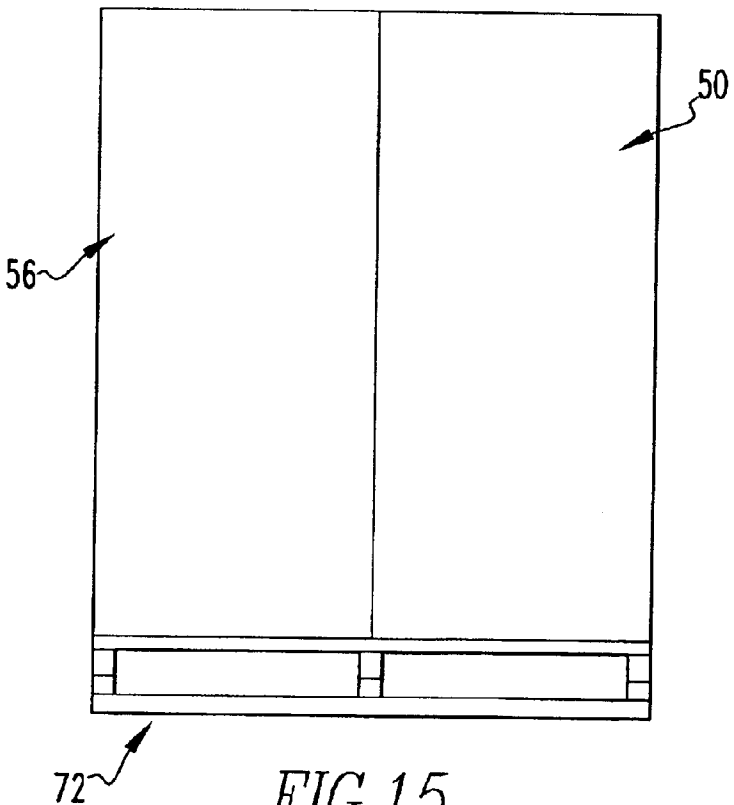
FIG. 15 is a side elevational view of the container shown in FIG. 13.
Figure 14:
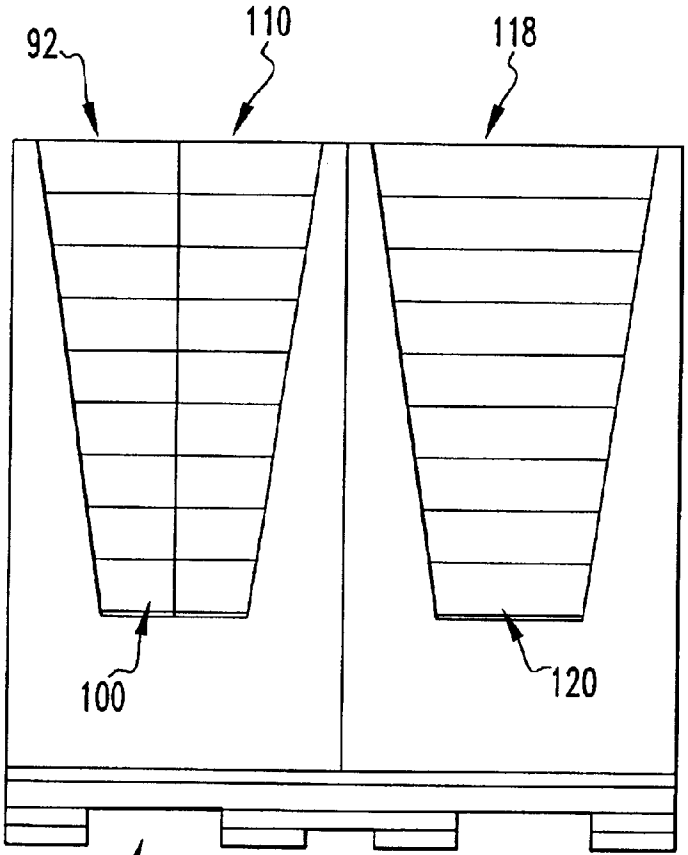
FIG. 14 is a front elevational view of the container shown in FIG. 13.
Figure 17:
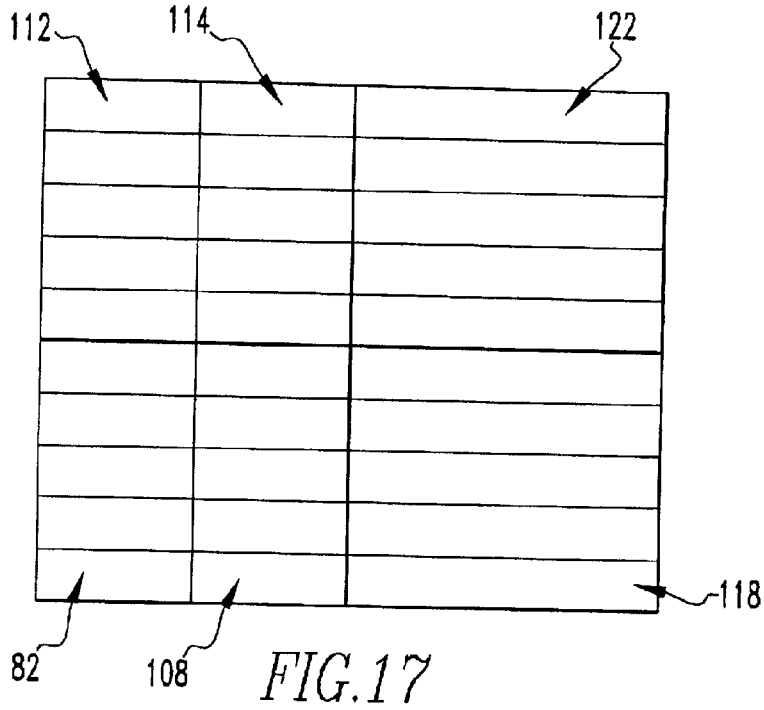
FIG. 17 is a top plan view of the container shown in FIG. 13.
Figure 16:
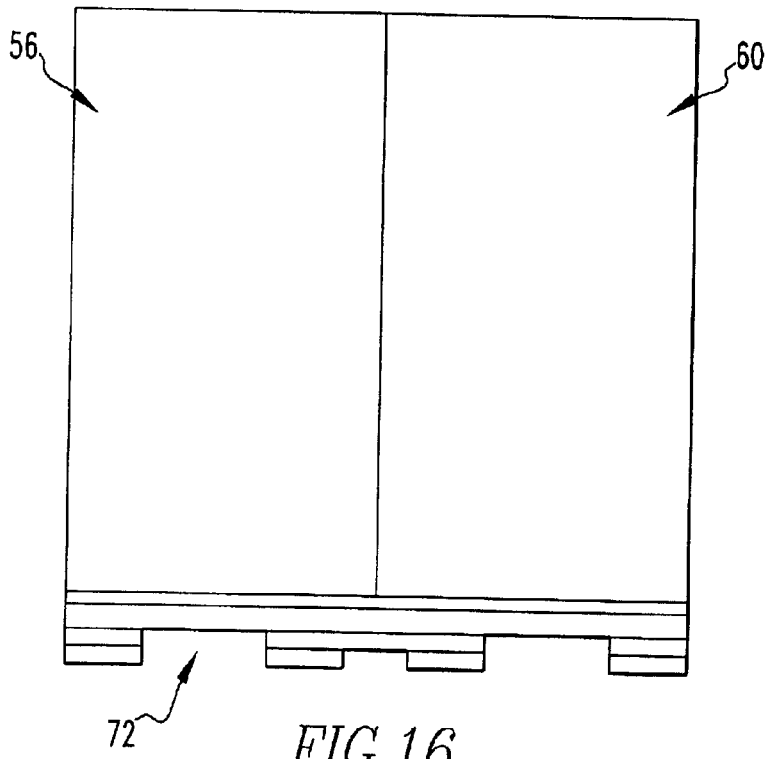
FIG. 16 is a rear elevational view of the container shown in FIG. 13.
Figure 18:
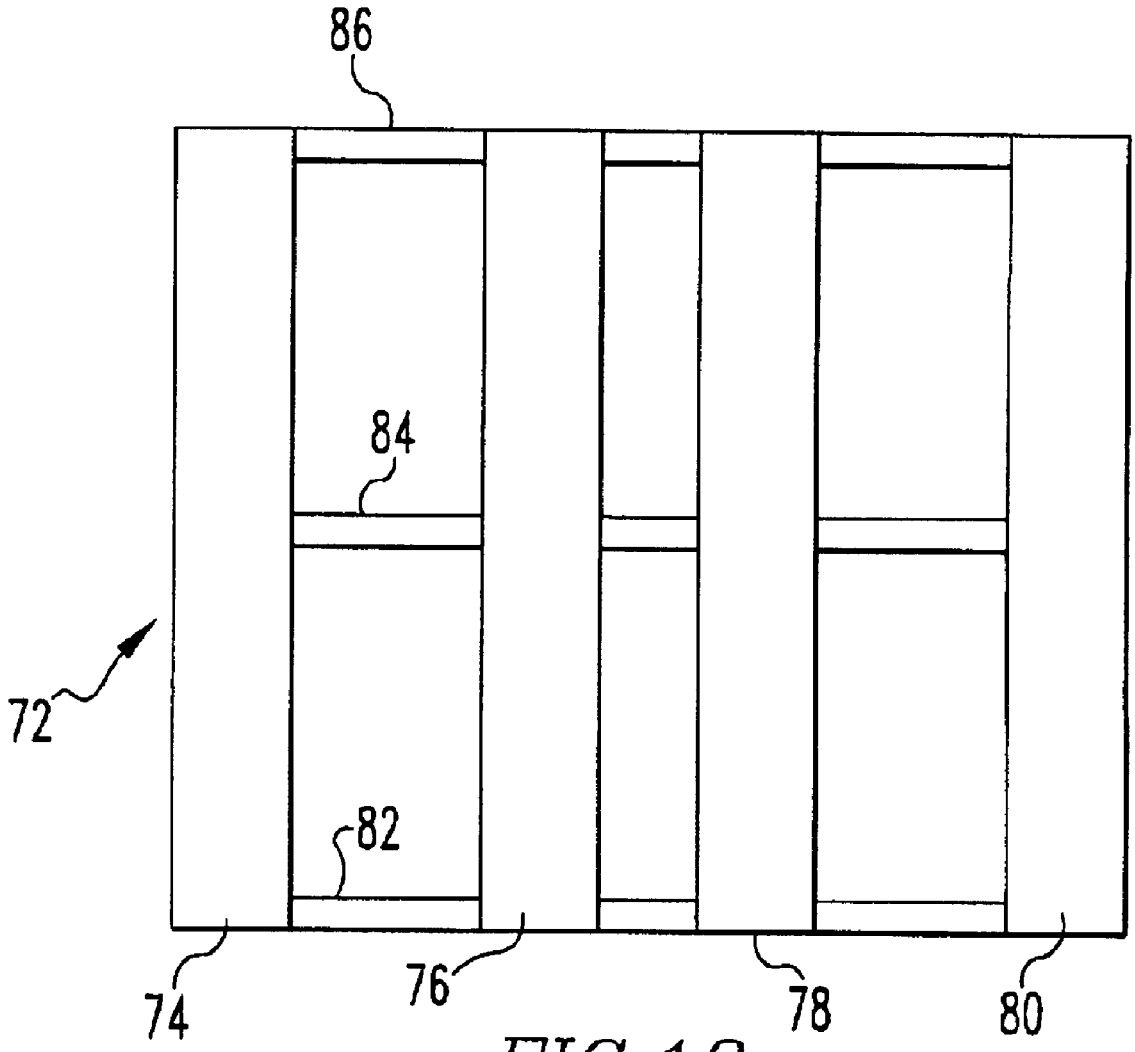
FIG. 18 is a bottom plan view of the container shown in FIG. 13.

Referring to FIGS. 13–18, the container 48 is shown in a configuration in which it is housing firelogs. In this configuration it is essentially identical to the one shown in FIGS. 7–12 in that the elements 50, 52, 54, and 66 are superimposed on a base palate 68 in the way described above. In this configuration the interiors of the elements are filled with firelogs. In element 50 there is a stack 92 of logs which are superimposed one on the top of another with the bottom of the log resting on the top of the log underneath. The top 94 of the upper log 96 is exposed at the top of the container. The sides of the log as at side 98 at log 96 are exposed in the cutout section 100 to allow easy removal of the logs by the buyers. The first ends as at end 102 of log 96 are adjacent the end panel 104 of element 50. The opposed end 106 bears against the end of a log 108 in a second vertical stack of logs 110 that is arranged in a similar way to stack 92. Two stacks of logs stacks 112 and 114 are also positioned in element 56. In element 52 a longer sized log as at log 116 is arranged in a stack 118 adjacent a front opening 120. A similarly arranged stack 122 is positioned in element 66. It would thus be appreciated that the container of this invention may also be packaged either so that all the elements will contain either relatively shorter logs as in element 50 or longer logs as at element 52.

It will also be understood that the present invention encompasses a method of displaying and dispensing firelogs in which the container is positioned either outside or inside a retail location in the way described and consumers remove one or more logs from the open tops and cut away sections for purchase.

Accordingly, the improved CONTAINER FOR BULK PACKAGING OF FIRELOGS AND METHOD OF USE apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the CONTAINER FOR BULK PACKAGING OF FIRELOGS AND METHOD OF USE is constructed and used, the characteristics of the construction, and the advantageous new and useful results obtained; the new and useful structures, devices, elements, arrangements, parts, and combinations are set forth in the appended claims.

What is claimed is:

1. A container for the bulk packaging of artificial firelogs comprising:

a generally rectangular base panel having a front side, a rear side and opposed ends;

a generally rectangular rear panel extending generally perpendicularly upwardly from the rear side of said base panel to a rear top edge;

opposed generally rectangular end panels extending generally perpendicularly upwardly from the opposed ends of base panel to a pair of generally parallel top edges; and a front panel extending generally perpendicularly from the front side of the rectangular base panel to a top front edge;

at least one cut away section formed in said front panel; wherein the cut away section is in the shape of a quadrilateral having a top side and a bottom side and opposed first and second lateral sides and the top side has a linear dimension and the bottom side has a linear dimension and the linear dimension of the top side is greater than the linear dimension of the bottom side; and in which the top side has opposed first and second ends and the bottom side has opposed first and second ends and the first lateral side slopes upwardly from the first end of the bottom side to the first end of the top side and the second side slopes upwardly from the second end of the bottom side to the second end of the top side and there is a first obtuse angle between the first lateral side and the bottom side and a second obtuse angle between the second lateral side and the bottom side and the first obtuse angle is equal to the second obtuse angle and the first and second obtuse angles are each from about 100° to about 150°; and a first plurality of firelogs arranged in the container in a first vertical stack positioned adjacent the cut away section of the front panel.

2. The container of claim 1, wherein the firelogs have opposed ends, opposed front and rear sides and opposed top and bottom sides and the firelogs are stacked on their bottom and top sides.

3. The container of claim 2, wherein the front side of the firelogs is adjacent the cut away section.

4. The container of claim 1, wherein a second plurality of firelogs is arranged in the container in a second vertical stack, the second vertical stack being positioned between the first vertical stack of firelogs and the rear panel.

5. The container of claim 1, wherein the firelogs in the second stack have opposed front and rear sides and opposed top and bottom sides and the firelogs in the second stack are stacked on their bottom and top sides.

6. A container for the bulk packing and display of artificial firelogs comprising:

(a) a first element comprising:

a generally rectangular base panel having a front side, a rear side and opposed ends;

a generally rectangular rear panel extending generally perpendicularly upwardly from the rear side of said base panel to a rear top edge;

opposed generally rectangular end panels extending generally perpendicularly upwardly from the opposed ends of the base panel to a pair of generally parallel end panel top edges;

a front panel extending generally perpendicularly from the front side of the rectangular base panel to a top front edge;

at least one cut away section formed in said front panel; and (b) a second element comprising:

a generally rectangular base panel having a front side, a rear side and opposed ends;

a generally rectangular rear panel extending generally perpendicularly upwardly from the rear side of said base panel to a rear top edge;

opposed generally rectangular end panels extending generally perpendicularly upwardly from the opposed ends of base panel to a pair of generally parallel end panel top edges;

a front panel extending generally perpendicularly from the front side of the rectangular base panel to a top front edge;

at least one cut away section formed in said front panel; and wherein said first and second elements are in abutting side by side relation and the cut away sections in the front panels of the first and second elements are each in the shape of a quadrilateral having a top side and bottom side and opposed first and second lateral sides and in which the top side has a linear dimension and the bottom side has a linear dimension and the linear dimension of the top side is greater than the linear dimension of the bottom side; and in which the top side has opposed first and second ends and the bottom side has opposed first and second ends and the first lateral side slopes upwardly from the first end of the bottom side to the first end of the top side and the second side slopes upwardly from the second end of the bottom side to the second end of the top side; and in which there is a first obtuse angle between the first lateral side and the bottom side and a second obtuse angle between the second lateral side and the bottom side and the first obtuse angle is equal to the second obtuse angle and in which there is a first plurality of firelogs arranged in a first vertical stack positioned adjacent the cutout portion of the front panel of at least one of the first and second elements.

7. The container of claim 6, wherein the firelogs have opposed ends, opposed front and rear sides and opposed top and bottom sides and the fire logs are stacked on their bottom and top sides.

8. The container of claim 7, wherein the front sides of the firelogs are adjacent the cut away section.

9. The container of claim 6, wherein a second plurality of firelogs is arranged in the container in a second vertical stack, the second vertical stack being positioned between the first vertical stack and the rear panel.

10. The container of claim 9, wherein the firelogs in the second stack have opposed ends, opposed front and rear sides and opposed top and bottom sides and the firelogs in the second stack are stacked on their bottom and top sides.

11. The container of claim 6, which further comprises a third element, and the third element comprises:

a generally rectangular base panel having a front side, a rear side and opposed ends;

a generally rectangular rear panel extending generally perpendicularly upwardly from the rear side of said base panel to a rear top edge;

opposed generally rectangular end panels extending generally perpendicularly upwardly from the opposed ends of base panel to a pair of generally parallel top edges; and a front panel extending generally perpendicularly from the front side of the rectangular base panel to a top front edge, at least one cut away section formed in the front panel; wherein the first and third elements are in abutting front and rear relation.

12. The container of claim 11, which further comprises a fourth element and the fourth element comprises;

a generally rectangular base panel having a front side, a rear side and opposed ends;

a generally rectangular rear panel extending generally perpendicularly upwardly from the rear side of said base panel to a rear top edge;

opposed generally rectangular end panels extending generally perpendicularly upwardly from the opposed ends of the base panel to a pair of generally parallel top edges; and a front panel extending generally perpendicularly from the front side of the rectangular base panel to a top front edge, at least one cut away section formed in the front panel, wherein the second and fourth elements are in abutting front and rear relation.

13. A method of displaying and dispensing firelogs to a plurality of customers comprising:

providing a generally rectangular base panel having a front side, a rear side and opposed ends;

providing a generally rectangular rear panel extending generally perpendicularly upwardly from the rear side of said base panel to a rear top edge;

providing opposed generally rectangular end panels extending generally perpendicularly upwardly from the opposed ends of the base panel to a pair of generally parallel top edges;

providing a front panel extending generally perpendicularly from the front side of the rectangular base panel to a top front edge, wherein said front panel has at least one cut away section, and a container is formed;

positioning a stack of firelogs in the container adjacent the cut away section of the front panel of the container; and allowing each of said plurality of customers to remove one or more firelogs from said stack of firelogs.

14. In combination, a display container and a plurality of artificial firelogs, wherein the combination comprises:

a first container unit having:

(a) a generally rectangular base panel having a front side, a rear side and opposed ends;

(b) a generally rectangular rear panel extending generally perpendicularly upwardly from the rear side of said base panel to a rear top edge;

(c) opposed generally rectangular end panels extending generally perpendicularly upwardly from the opposed ends of base panel to a pair of generally parallel top edges; and (d) a front panel extending generally perpendicularly from the front side of the rectangular base panel to a top front edge, (e) at least one cut away section formed in said front panel; wherein the at least one cut away section in the front panel is in the shape of a quadrilateral having a top side and a bottom side and opposed first and second lateral sides; and the top side has a linear dimension and the bottom side has a linear dimension and the linear dimension of the top side is greater than the linear dimension of the bottom side; and a plurality of artificial firelogs arranged in a first vertical stack positioned adjacent the cut away section of the front panel.

15. The combination of claim 14 in which the firelogs have opposed ends, opposed front and rear sides and opposed top and bottom sides and the firelogs are stacked on their bottom and top sides and the front side of the firelogs is adjacent the cut away section of the front panel of the container.

16. The combination of claim 14, in which the top side of the container has opposed first and second ends and the bottom side has opposed first and second ends and the first lateral side slopes upwardly from the first end of the bottom side to the first end of the top side and the second side slopes upwardly from the second end of the bottom side to the second end of the top side.

17. The combination of claim 14, wherein there is a first obtuse angle between the first lateral side and the bottom side and a second obtuse angle between the second lateral side and the bottom side and the first obtuse angle is equal to the second obtuse angle.

18. The combination of claim 16, wherein the first and second obtuse angles are each from about 100° to about 150°.

19. The combination of claim 14, further comprising a second plurality of firelogs arranged in a second vertical stack positioned between the first vertical stack of firelogs and the rear panel.

20. The combination of claim 14, further comprising a second container unit having:

(a) a generally rectangular base panel having a front side, a rear side and opposed ends;

(b) a generally rectangular rear panel extending generally perpendicularly upwardly from the rear side of said base panel to a rear top edge;

(c) opposed generally rectangular end panels extending generally perpendicularly upwardly from the opposed ends of base panel to a pair of generally parallel top edges; and (d) a front panel extending generally perpendicularly from the front side of the rectangular base panel to a top front edge, (e) at least one cut away section formed in said front panel; wherein the at least one cut away section in the front panel is in the shape of a quadrilateral having a top side and a bottom side and opposed first and second lateral sides; and the top side has a linear dimension and the bottom side has a linear dimension and the linear dimension of the top side is greater than the linear dimension of the bottom side; and in which the first container unit and second container unit are in abutting contact with each other and the first container unit and second container unit are substantially identical in physical configuration.

21. The combination of claim 20 further comprising a plurality of artificial firelogs arranged in a first vertical stack positioned adjacent the cut away section of the front panel of the second container unit.

22. The combination of claim 21, further comprising a second plurality of firelogs arranged in a second vertical stack positioned between the first vertical stack of firelogs and the rear panel of the second container unit.

* * * * *